United States Patent [19]

Schiemann

[11] Patent Number: 4,881,647

[45] Date of Patent: Nov. 21, 1989

[54] PLASTICS CAN

[76] Inventor: Wolfram Schiemann, Eugen-Nagele-Strasse, 7140 Ludwigsburg, Fed. Rep. of Germany

[21] Appl. No.: 271,494

[22] Filed: Nov. 15, 1988

[30] Foreign Application Priority Data

Apr. 29, 1988 [DE] Fed. Rep. of Germany ..... 3814558

[51] Int. Cl.[4] ..... B65D 21/02; B65D 41/06

[52] U.S. Cl. ..... 206/510; 215/10; 220/293; 220/301

[58] Field of Search ..... 206/510; 215/10; 220/293, 301, 318

[56] References Cited

U.S. PATENT DOCUMENTS 578,176 3/1897 Weeks ..... 215/10
3,394,836 7/1968 Millard ..... 220/301
3,746,200 7/1973 Flider ..... 215/10
4,014,367 3/1977 Milo ..... 220/318
4,491,251 1/1985 Pratz ..... 220/318
4,541,529 9/1985 Hestehave ..... 206/510
4,805,793 2/1989 Brandt ..... 206/510

*Primary Examiner*—George E. Lowrance

[57] ABSTRACT

A plastics can 15 has a screw closure comprising a screw cap 34. In the closed position, a flat surface 44 of the screw cap 34 lies in one common horizontal plane with the upper edge of two edge handles 28, 29. When several such cans are stacked one upon another, as the result of the additional support on the flat surface 44, greater stability is achieved. Such cans can, therefore, be stacked with less danger. Of particular importance for cans of more than 10 liter capacity (FIG. 1).

14 Claims, 6 Drawing Sheets

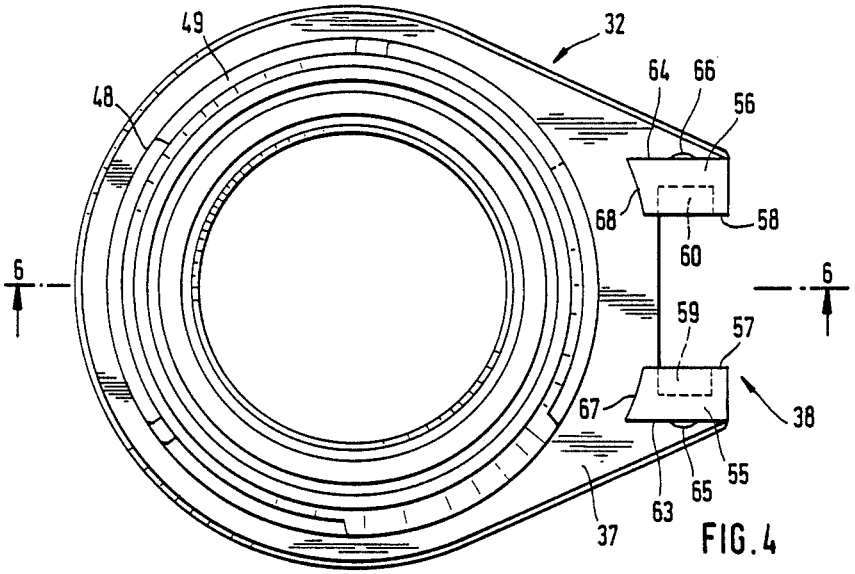
FIG. 4
FIG. 5
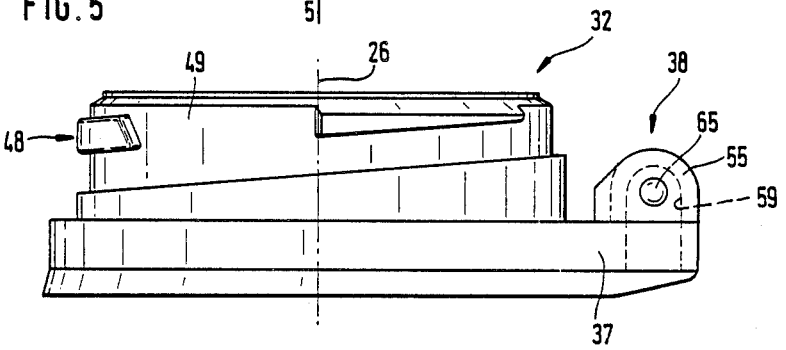
FIG. 6
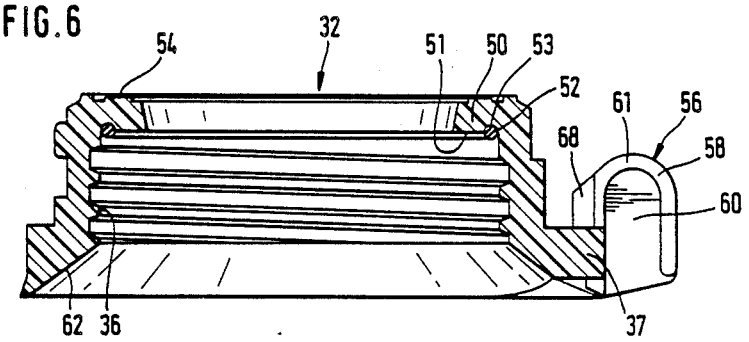

PLASTICS CAN

This invention relates to a plastic can in the region of ten or more liters capacity. Such cans have a bottom wall with a standing surface thereon, a top wall opposite to the bottom wall with a portion inclined towards a front wall, a back wall opposite to the front wall, two lateral walls, a pouring spout on the portion of the top wall inclined towards the front wall, and a screw cap adapted to rotate to a closed state for closure of the pouring spout.

BACKGROUND OF THE INVENTION

A can of this type is described, for instance in DE No. 35 35 736Al. When two or more identical cans are stacked upon one another, the bottom standing surface of the upper can in each case finds its hearing basically only upon the handles of the can next below. Since these handles extend usually not more than two-thirds of the distance from the back wall to the front wall, the front third of the upper can thus remains unsupported. Even slight movements are then sufficient, by the surging of liquid inside the can, to overcome the stable stacked position, giving rise to risks in the stacking of several cans.

OBJECT AND SUMMARY OF THE INVENTION

The objective of the invention is so to provide a plastic can of the type described with improved stacking capability.

This objective is achieved by the following features:

A device arrests the screw cap in its closed state in a predetermined rotational position. Two bar-shaped handles molded from the upper wall and spaced apart from each other have upper edges that are tangential to an imaginary plane extending parallel to the standing surface of the bottom wall. The screw cap has an upper face with a first plane surface that in the closed state is the highest raised portion of the screw cap and is tangential to the imaginary plane.

A portion of the screw cap now also serves as seating surface, so that the unsupported overhang of the upper can is considerably shortened.

The embodiment described includes the following additional advantageous features:

The screw cap has a cylindrical wall with an internal thread. The pouring spout has a corresponding external thread and a pouring opening. The screw cap has a cover plate following the cylindrical wall with an inner surface arranged for sealing closure of the pouring opening and an upper external surface that comprises the first plane surface of the screw cap. And the cover plate has a non-circular outline as viewed along the geometrical longitudinal axis of the cylindrical wall of the screw cap. This embodiment makes it easy to grip the screw cap firmly and thus reliably to bring it into the correct closure rotational position.

The first plane surface is inclined in a radial direction at an acute angle to the geometrical longitudinal axis of the cylindrical wall, is orientated in the transverse direction perpendicularly to the geometrical longitudinal axis and leads with a rounded zone into a second plane surface that is orientated radially and transversely perpendicularly to the geometrical longitudinal axis. The first plane surface has an outer edge and extends in the radial direction over about 2/3 of the distance from the outer edge to the geometrical longitudinal axis. Accordingly, a compromise is obtained between size of seating surface and amount of material used. If the first, flat surface were to be continued without a kink, then the screw cap would have such a height at one side that it could no longer be economically manufactured as an injection molded component.

It is important in stacking that the screw cap be in a defined rotational position and reliably arrested in this position. To this extent, the following features result in an ergonomically favorable and stable pivoting lever arresting device. The cover plate has four plane peripheral surfaces corresponding to a rectangular outline, which are connected together by rounded corners, and an upwardly projecting component is provided that is in a stable position with respect to the pouring spout. And the device for arresting rotation of the screw cap comprises a U-shaped pivoting lever having U-arms pivotally journalled on opposite ones of the peripheral surfaces of the cover plate and a yoke that in the rotation arresting condition is hollow and open towards the top wall and in the closed state of the screw cap engages over the upwardly projecting component.

The U-arms and the yoke in the arresting condition each adjoin closely the periphery of the cover plate and have an upper face constituting a continuation of the first plane surface.

The yoke of the pivoting lever is adapted to snap-engage with the upwardly projecting component in the arresting condition. The external surfaces face away from and parallel to each other. Opposite to the lateral surfaces detent projections are provided on the external surfaces. The yoke of the pivoting lever has mutually opposite lateral internal walls with depressions therein. The detent projections can be snap-engaged into the depressions, and the yoke covers in the manner of a cap the two bearing eyes in the arresting condition.

In order that the screw cap shall be available as intended as a seating, the following is recommended, by which it is held and guided in a manner preventing loss but allowing unimpeded actuation. It cannot get lost. The upwardly projecting component is a pivot bearing block for a guide ring, with a pivot axis oriented tangentially with respect to the cylindrical wall and having limited axial displacement with respect to the geometrical longitudinal axis. The upwardly projecting component comprises two bearing eyes spaced from each other in the tangential direction, with lateral surfaces facing towards and parallel to each other, with an axially extending longitudinal groove in each that is axially limited. A projection guided between the lateral surfaces is formed on the periphery of the guide ring. And trunnions project tangentially on opposite sides of the projection and are held in the longitudinal grooves. The cylindrical wall of the screw cap has a circumferential groove in which the guide ring is slidably inserted so that the screw cap is guided rotatably about the cylinder axis relative to the guide ring but captive in the axial direction.

The pouring spout has a radially projection plate segment. The top wall has a spout seating projecting integrally out of the top wall. The upwardly projecting component is integrally formed on the radially projecting plate segment of the pouring spout. And the pouring spout is mounted fixed at the factory on the spout seating. The pouring spout is preferably manufactured according to these features as a separate injection molded component, because in this way the necessary accuracy of shape and stability of form can be more readily achieved and the upwardly projection component, which should be formed as above described, can also be more accurately and stably constructed than if it were formed in one piece out of the upper wall of the can.

The bearing eye has a materially integral web and the longitudinal groove is bounded axially at one end by the top wall and at the other end by the materially integral web. Accordingly, the longitudinal groove is bounded or limited at both ends in the final condition, so that the projection of the guide ring cannot slip out. On the other hand, the projection can be inserted into the longitudinal groove without problems, provided that the pouring spout has not yet been fitted to the spout seating.

The stable stacking of several cans one above another is still further improved by the following features, because in this way an automatic alignment is achieved.

Standing surfaces corresponding to the handles and the first plane surface of the screw cap are formed somewhat recessed in the bottom wall in such a way that, when identical plastic cans are stacked on upon another, the handles and the first plane surface are surrounded bty regions of the bottom wall of the plastic can standing thereon, so that the upper can is secured against slipping laterally off of the lower can.

DESCRIPTION OF THE DRAWINGS

Further advantageous embodiments and forms of construction of this invention will be apparent from the following description of a preferred example of embodiment with reference to to drawings:

The FIGS. in the drawings show:

FIG. 4 is a plan on the pouring spout of FIG. 3, FIG. 5 is a view in the direction of arrow 5 of FIG. 4.

FIG. 6 is a sectional view in the plane 6—6 of FIG. 4,

DETAILED DESCRIPTION OF A PREFERRED EMBOIDMENTS

Figure 1:
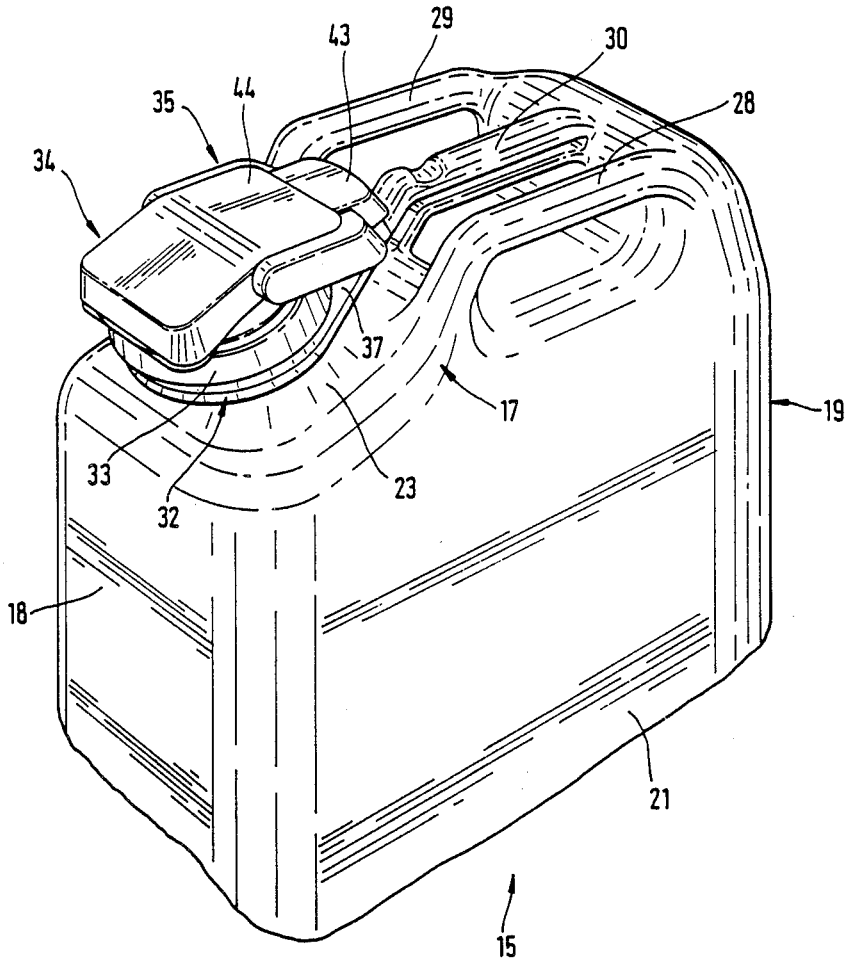
FIG. 1 is a perspective view of the upper part of a plastic can according to this invention.
Figure 2:
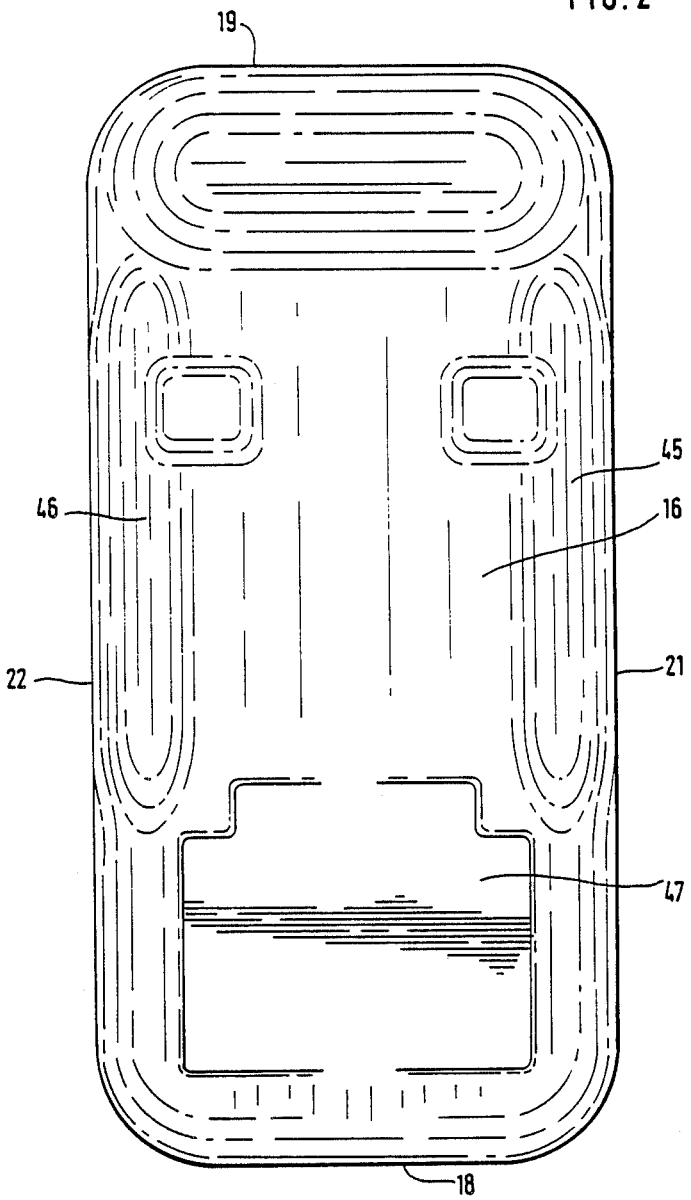
FIG. 2 is a plan on the bottom wall of the can of FIG. 1 to a reduced scale.
Figure 3:
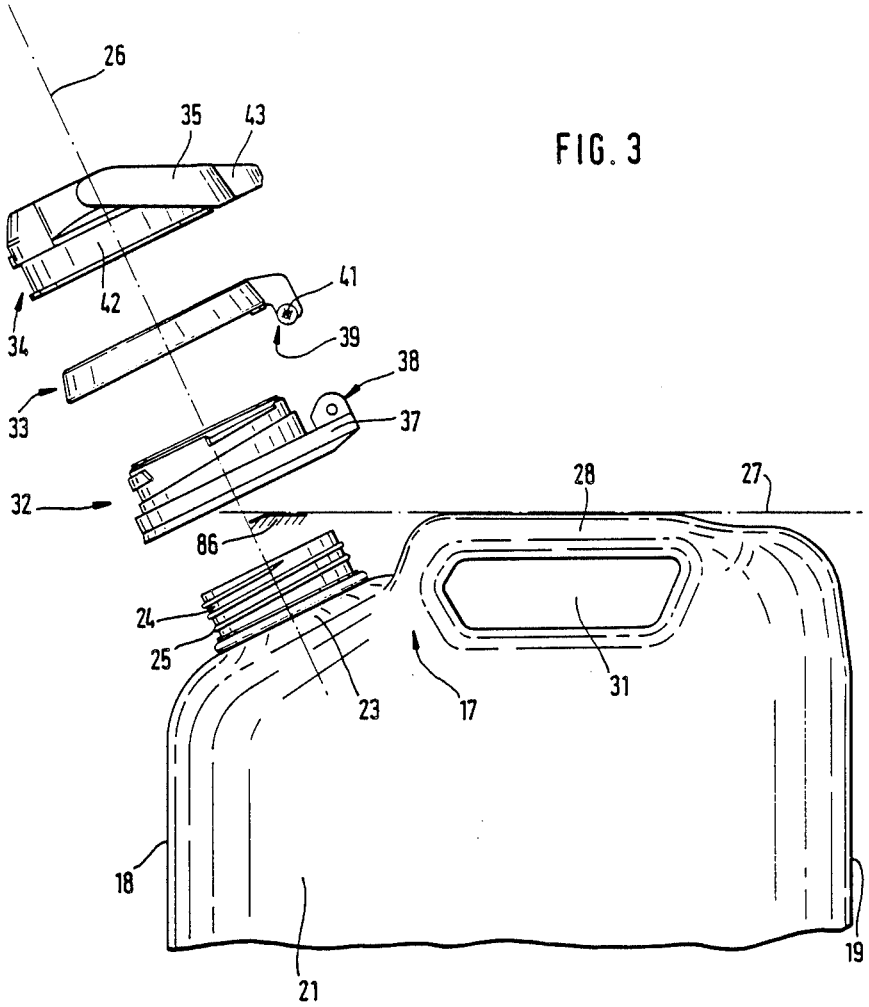
FIG. 3 is a lateral view of the can of FIG. 1 in an exploded view.

In FIGS. 1 to 3, a 20-liter plastic can 15, itself of known construction, is illustrated, which possesses a bottom wall 16 (FIG. 2), a top wall 17 (FIGS. 1 and 3), a front wall 18, a rear wall 19 and two side walls 21, 22. The top wall 17 has a portion 23 inclined to the front wall 18 and the obtuse angle between them is about 115 degrees. Approximately centrally of this portion 23, a projecting spout seating 24 is integrally formed (FIG. 3), which carries an external thread 25 and is coaxial to a geometrical longitudinal axis 26, which is orientated perpendicularly to the surface of the part 23 and consequently at the same obtuse angle of about 115 degrees to a horizontal plane 27. In the top wall 17, as seen in FIGS. 1 and 3 at right, three bar-shaped handles 28, 29 and 30 are integrally molded, following the part 23, the upper edges of which handles are tangential to the imaginary plane 27. This is true at least for the two handles 28, 29 adjoining the side walls 21, 22. The central handle 30 may be situated somewhat lower or be omitted entirely in the case of smaller cans. Underneath the handles there is a gripping recess 31 and beneath this the top wall 17 is closed. The known plastic can 15 so far described is preferably injection blow-molded.

In the exploded view of FIG. 3, the additional components to be made separately as plastic injection moldings can be seen as follows: a pouring spout 32, a guide ring 33 and a screw cap 34 with pivoting lever 35. These components are described in greater detail below. As a first summary, however, their cooperating action will be briefly discussed in relation to FIG. 3.

The pouring spout 32 has an internal thread 36, seen in FIG. 6, which corresponds with the external thread 25. Thus the pouring spout 32 can be fixed to the spout seating 24, the thread having only a secondary function and therefore being virtually not used again. The pouring spout 32 is so fitted that a radially projecting plate segment 37 integrally formed thereon is aligned exactly in the plane of symmetry of the can towards the handle 30. On this plate segment 37 there is a pivot bearing block 38, on which a projection 39, integrally formed tangentially on the guide ring 33, is journalled.

The guide ring 33 can be pivoted upwards clockwise in the plane of the drawing of FIG. 3 as a consequence of its mounting, to be described later in more detail, about a pivot axis 41 orientated parallel to the plane 27 and tangentially to the spout seating 24. At the same time, the projection 39 is displaceable to a limited extent in the pivot bearing block 38 in a direction parallel to the geometrical longitudinal axis 26. The guide ring 33 engages into a circumferential groove 42 on the screw cap 34 in such a manner that the screw cap 34 is guided rotatably relative to the guide ring 33 but virtually not movable axially. Thus the screw cap 34 is held captive to the pouring spout 32 and can be screwed on and off in the necessary manner and also pivoted away upwards.

In the closed position according to FIG. 1, the yoke 43 of pivoting lever 35, open like a beaker towards the top wall 17, fits over the pivot bearing block 38, engages with it and thus holds the screw cap 34 firmly in its exact rotated position.

The upper face of the screw cap 34 is provided with a first plane surface 44, which in the closed condition according to FIG. 1, as the highest raised portion of the screw cap, is tangential to the plane 27 (FIG. 3) and serves, together with the upper edges of the handles 28, 29, as seating surface for the bottom wall of a further can to be set thereon. The corresponding standing surfaces 45, 46 and 47 are somewhat recessed according to FIG. 2 as depressions into the bottom wall 16, corresponding approximately to half the thickness of the handles 28, 29, so that a form-fitting coupling of cans stacked one upon another takes place, ensuring that the stack is correctly aligned.

The pivoting lever 35 is shaped, according to FIG. 1, to follow the contour of the screw cap 34, therefore constitutes a continuation of this cap in the arrested condition and also bears against the recessed standing surface 47 of a can standing above it. In any case, the pivoting lever 35 does not project above the plane surface 44 when it is correctly engaged. If, therefore, the can is not correctly closed, this is immediately noticeable if another can is placed on it. In this way it is ensured that cans stacked one upon another are always correctly closed and arrested.

As can be seen from FIG. 1, the pivoting lever 35, mounted externally on the screw cap 34, can be easily engaged from below and pivoted upwards, even by a gloved hand.

The pouring spout 32 is illustrated full-size in FIGS. 4 to 6. It is formed basically as a cylinder, which carries internally the internal thread 36 already mentioned and externally a segmented external thread 48 of the type described in DE 35 35 736 A1. At the top, an annular flange 50 projects radially inwards, the internal annular surface 51 of which is arranged for sealing bearing against the end face of the spout seating 24. Preferably, to provide a better seal, a sealing ring 52 is retained in a groove 53. The outer annular surface 54 is loaded by the internal surface of the screw cap, as will be shown later. At the bottom, the already mentioned plate segment 37 is integrally formed, together with the pivot bearing block 38, the construction of which will now be described in detail.

The pivot bearing block 38 consists of two bearing eyes 55, 56, arranged spaced apart in the tangential direction, in each of the lateral faces 57, 58 of which, facing towards and parallel to each other, there is integrally formed a longitudinal groove 59, 60, extending axially. By the example of the longitudinal groove 60 in FIG. 6, it can be seen that this is closed at the top by an integrally formed, arc-shaped web 61 of the bearing eye 56, but is open downwards. The longitudinal groove 59 is of the same form.

At the lower edge of the pouring spout 32, finally, a funnel-shaped divergence 62 is provided, in order to provide space for the beading at the transition between the top wall 17 (or its part 23) and the spout seating 24, so that in the assembled state the pouring spout shall tightly adjoin the part 23. In the final condition, the longitudinal grooves 59, 60 are bounded at the bottom by the top wall 17 of the can.

On the external faces 63, 64, opposite respectively the lateral surfaces 57, 58, facing away from each other and orientated parallel with each other, of the bearing eyes 55, 56, detent projections 65, 66 are formed, to which reference will be made later. The radially inwardly orientated walls 67, 68 of the bearing eyes are orientated concentrically to and at a distance from the cylindrical part of the pouring spout, to allow space for a cylindrical flange of the screw cap 34, to be explained later.

Figure 7:
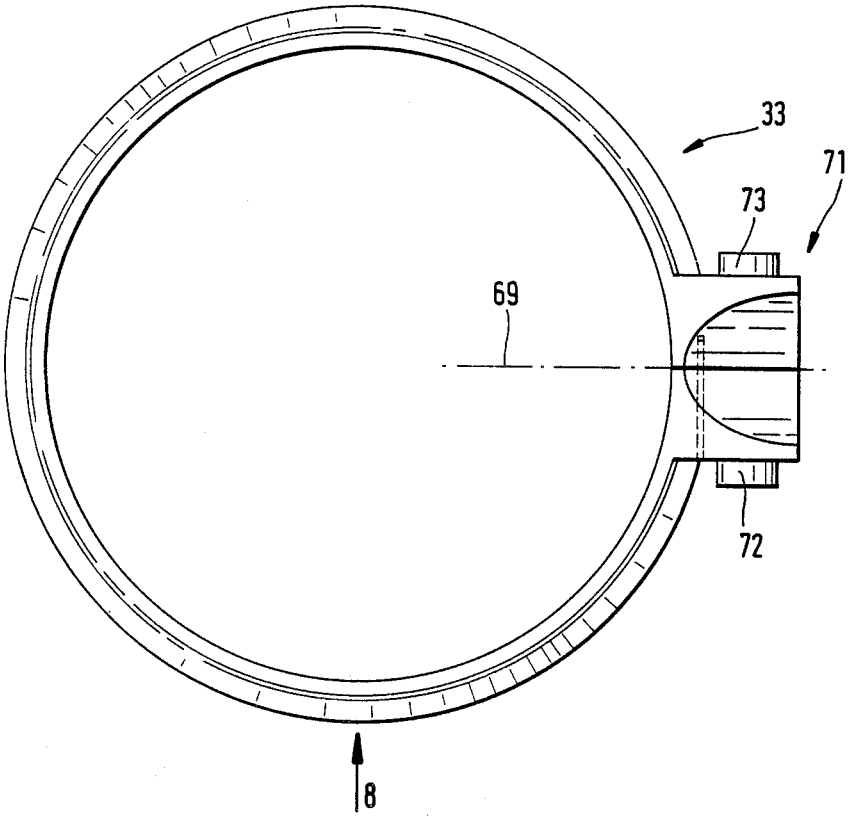
FIG. 7 is a plan on the guide ring of FIG. 3.
Figure 8:
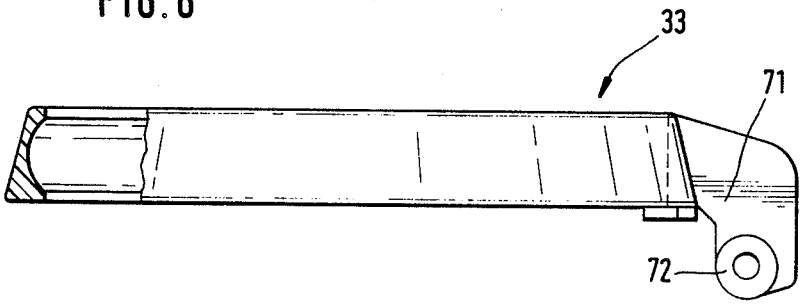
FIG. 8 is a view in the direction of arrow 8 of FIG. 7.

The guide ring 33 is, according to FIGS. 7 and 8, interrupted at one point and carries, symmetrically split about this radial parting plane 69, a peripheral projection 71 of general knee-shape as seen in the lateral view of FIG. 8. On opposite sides thereof, circular trunnions 72, 73 extend tangentially therefrom, the diameter of which is somewhat smaller than the clear width of the longitudinal grooves 59, 60 (FIG. 4) as measured in the radial direction. The height of the trunnions 72, 73 corresponds to the depth of the longitudinal grooves 59, 60 and the width of the projection 71 between the trunnions 72, 73 is somewhat smaller than the distance between the lateral surfaces 57, 58, but smaller only by a sufficient amount to allow the projection 71 to be guided without jamming between the lateral surfaces, but without allowing it to tilt to the side.

Figure 9:
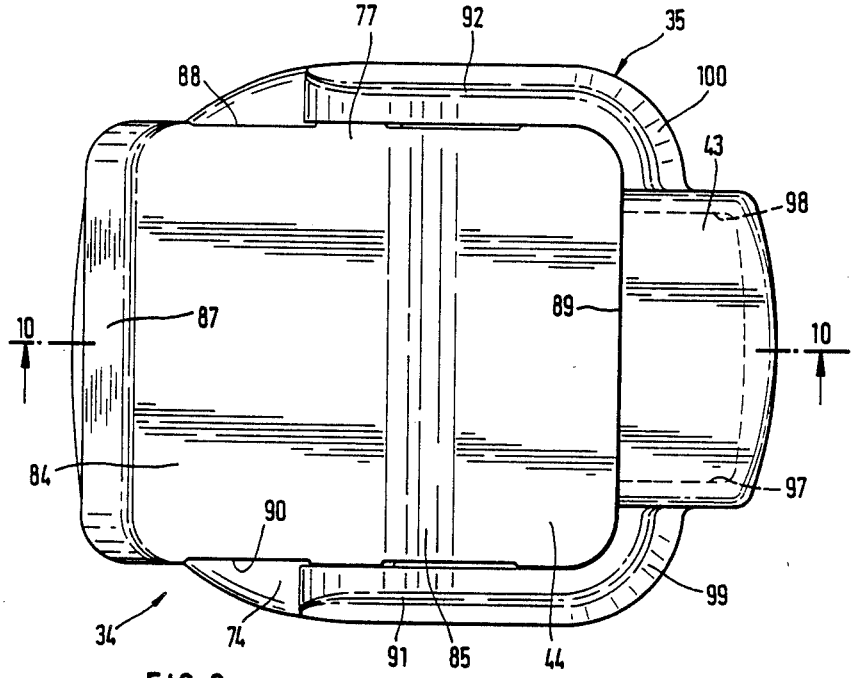
FIG. 9 is a plan on the screw cap of FIG. 3.
Figure 10:
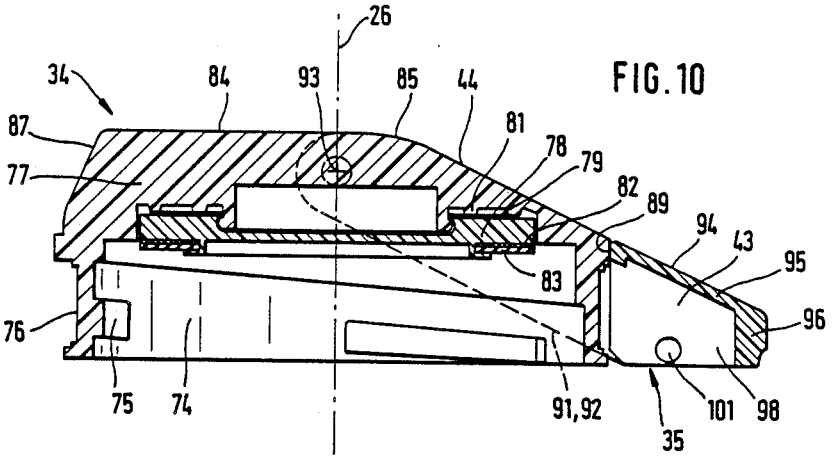
FIG. 10 is a sectional view on the plane 10—10 of FIG. 9.

The screw cap 34 has, according to FIGS. 9 and 10, a cylindrical wall 74 having a segmented internal thread 75, corresponding to the segmented external thread 48 of the pouring spout 32, as is described in DE 35 35 736 A1. The advantage of this screw connection is that the components can be pushed onto one another and then screwed together by a small rotation of at most 180°.

On the outer face of the cylindrical wall 74, a circumferential groove 76 is provided, into which the guide ring 33 engages with only small clearance. Since the ring is interrupted in the parting plane 69 (FIG. 7) it can be sprung outwards without difficulty to enable it to be inserted from below (in FIG. 10) over the wall 74 and into the circumferential groove 76.

The cylindrical wall 74 is followed by a cover plate 77, the internal surface of which is arranged to provide sealed closure of the opening of the pouring spout 32. For this purpose, a closure plate 78 is clipped, coaxially rotatable, to it. The upper face 79 of the closure plate is, in the closed position, pressed sealingly against annular ribs 81, while its lower face 82 is pressed, with a sealing ring 83 bearing thereon, against the annular surface 54 of the pouring spout 32 to form a seal. The cover plate 77, which is injection moulded in one piece with the wall 74, has in the plan according to FIG. 9 a generally rectangular outline with rounded corners. The outline could also be square or octagonal or generally simply non-circular, so that the screw cap can be easily gripped without slipping and rotated. The rectangular form shown is aesthetically very appealing, since it harmonized with the rectangular shape of the can and facilitates easy handling and provides a stable mounting for the pivoting lever 35.

The upper face of the cover plate 77 is angled like a roof and is divided into the first plane surface 44 and a second plane surface 84, together with a rounded zone 85 between them. The second plane surface 84 is aligned, both in the radial direction and also transversely thereto, perpendicularly to the geometrical longitudinal axis 26. The first plane surface 44, in contrast, is inclined in the radial direction at an acute angle of about 65° to the geometrical longitudinal axis 26 and, in the transverse direction, perpendicularly thereto. The first plane surface extends radially from its outer edge (at right in FIGS. 9 and 10) not quite as far as the centre or geometrical longitudinal axis 26, but only over about two-thirds of this distance. If it were to extend further, the left part of the cover plate in the view of FIG. 10 would have to be still thicker, which would mean an excessive amount of material at one side of the solid injection moulding. It can be seen from the contour 86 shown hatched in FIG. 3, which illustrates the position of the first plane surface in the closure condition, that even with this cranked upper side of the cover plate a considerable extension of the supporting base is achieved.

The cover plate 77 has four generally flat peripheral surfaces 87, 88, 89, 90, which are connected by rounded corners. The peripheral surface 87 is inclined somewhat in relation to the geometrical longitudinal axis 26, whereas the other three peripheral surfaces are aligned parallel to the geometrical longitudinal axis 26. As a consequence of the first flat surface 44 descending like a wedge, the lateral peripheral surfaces 88 and 90 have a trapezium shape and the peripheral surface 89 is consequently reduced to a slender strip.

The pivoting lever 35 fits in U-shape around the cover plate 77, its U-arms 91, 92 lying against the peripheral surfaces 88, 90 and being pivotally attached about a transverse axis 93, crossing through the geometrical longitudinal axis 26, to the cover plate 77. For this purpose, two short blind holes may be provided in the cover plate 77, in which trunnions which are integrally formed on the inner faces of the U-arms 91, 92 are guided. Some other type of mounting could also be provided. The yoke 43 of the pivoting lever 35 adjoins the peripheral surface 89 and its upper face 94 constitutes, in the arresting condition illustrated in FIG. 10, a continuation of the first plane surface 44. The contour of the U-arms 91, 92 is also illustrated in broken line in FIG. 10. It can be seen from this that the U-arms are inclined and also cover over parts of the cylindrical wall 74. For opening the closure, the pivoting lever 35 can be pivoted to the left through more than 180° out of the arresting position shown.

The yoke 43 is constructed as a hollow object open towards the underside, that is to say in the assembled state towards the top wall 17, 23, and comprising a cover wall 95 (having the upper face 94), a slightly curved end wall 96, extending generally concentrically to the geometrical longitudinal axis 26, and two parallel, mutually opposite lateral internal walls 97, 98. From these, curved parts 99, 100 depart outwards, which continue round the corner into the associated U-arm 91 or 92 respectively. The distance between the lateral internal walls 97, 98 is somewhat larger than the distance between the outer surfaces 63, 64 (FIG. 4), so that the bearing block 38 just fits into this hollow object. According to FIG. 10, a detent depression 101 is situated in the lateral inner wall 98, as also in the opposite lateral inner wall 97. These detent depressions are so positioned that, in the closed position of the screw cap 34 and arresting position of the pivoting lever 35, the detent projections 65, 66 (FIG. 4) engage into them. As a result of a certain elasticity of the lateral inner walls 97, 98, the spring action necessary for this purpose is available.

The assembling of the above described components into a complete can is simple to carry out as follows:

First the guide ring 33 is seated in the circumferential groove 76 of the screw cap 34. Then the projection 71 of the guide ring 33 is pushed from the (still) open lower side between the bearing eyes 55, 56 of the pouring spout 32, so that the trunnions 72, 73 are seated in the longitudinal grooves 59, 60. In this way the guide ring 33 is already held together sufficiently firmly at its division point and can no longer become released from the screw cap 34. The pouring spout 32 (together with the components fixed thereto) is now screwed onto the spout seating 24. The top wall 17, 23 now prevents the projection 71 of the guide ring 33 from slipping out from its bearing between the bearing eyes 55, 56. Assembly is thus already completed.

As a result of the screw connection between the pouring spout 32 and the spout seating 24, the closure can also be dismantled in order to replace a damaged component for instance. If this repair possibility is not required, a glued connection can be provided instead.

It will be understood that the above description applies equally well to a can of 10 liters or 30 liters capacity. A smaller can might differ from this example, mainly in that the central handle would be omitted.

What is claimed is:

1. Plastic can having a capacity in the region of 10 liters and more, comprising a bottom wall with a standing surface thereon, a top wall opposite to said bottom wall, a front wall, said top wall having a portion inclined towards said front wall, a back wall opposite to said front wall, two lateral walls, a pouring spout on said portion of said top wall inclined towards said front wall, a screw cap adapted to rotate to a closed state for closure of said pouring spout, a device for arresting said screw cap in said closed state in a predetermined rotational position and two bar-shaped handles molded from said upper wall and spaced apart from each other, said handles having upper edges that are tangential to an imaginary plane extending parallel to said standing surface of said bottom wall, said screw cap having an upper face with a first plane surface that in said closed state is the highest raised portion of said screw cap and is tangential to said imaginary plane.

2. Plastic can according to claim 1, wherein said screw cap has cylindrical wall with an internal thread, said pouring spout has a corresponding external thread and a pouring opening, said screw cap has a cover plate following said cylindrical wall with an inner surface arranged for sealing closure of said pouring opening and an upper external surface that comprises said first plane surface of said screw cap, and said cover plate has a non-circular outline as viewed along the geometrical longitudinal axis of said cylindrical wall of said screw cap.

3. Plastic can according to claim 2, wherein said first plane surface is inclined in a radial direction at an acute angle to said geometrical longitudinal axis of said cylindrical wall, is orientated in the transverse direction perpendicularly to said geometrical longitudinal axis and leads with a rounded zone into a second plane surface that is orientated radially and transversely perpendicularly to said geometrical longitudinal axis.

4. Plastic can according to claim 3, wherein said first plane surface has an outer edge and extends in the radial direction over about 2/3 of the distance from said outer edge to said geometrical longitudinal axis.

5. Plastic can according to claim 2, wherein said cover plate has four plane peripheral surfaces corresponding to a rectangular outline, which are connected together by rounded corners, and an upwardly projecting component is provided that is in a stable position with respect to said pouring spout, and said device for arresting rotation of said screw cap comprises a U-shaped pivoting lever having U-arms pivotally journalled on opposite ones of said peripheral surfaces of said cover plate and a yoke that in said rotation arresting condition is hollow and open towards said top wall and in said closed state of said screw cap engages over said upwardly projecting component.

6. Plastic can according to claim 5, wherein said U-arms and said yoke in the arresting condition each adjoin closely the periphery of said cover plate and have an upper face constituting a continuation of said first plane surface

7. Plastic can according to claim 5 wherein said yoke of said pivoting lever is adapted to snap-engage with said upwardly projecting component in the arresting condition.

8. Plastic can according to claim 5, wherein said upwardly projecting component is a pivot bearing block for a guide ring, with a pivot axis orientated tangentially with respect to said cylindrical wall and having limited axial displacement with respect to said geometrical longitudinal axis.

9. Plastic can according to claim 8, wherein said upwardly projecting component comprises two bearing eyes spaced from each other in the tangential direction, with lateral surfaces facing towards and parallel to each other, with an axially extending longitudinal groove in each that is axially limited, and a projection guided between said lateral surfaces is formed on the periphery of said guide ring, and trunnions project tangentially on opposite sides of said projection and are held in said longitudinal grooves.

10. Plastic can according to claim 9, wherein said external surfaces face away from and parallel to each other, opposite to said lateral surfaces detent projections are provided on said external surfaces, said yoke of said pivoting lever has mutually opposite lateral internal walls with depressions therein, said detent projections can be snap-engaged into said depressions, and said yoke covers in the manner of a cap said two bearing eyes in the arresting condition.

11. Plastic can according to claim 8, wherein said cylindrical wall of said screw cap has a circumferential groove in which said guide ring is slidably inserted so that said screw cap is guided rotatably about the cylinder axis relative to said guide ring but captive in the axial direction.

12. Plastic can according to claim 8, wherein said pouring spout has a radially projecting plate segment, said top wall has a spout seating projecting integrally out of said top wall, said upwardly projecting component is integrally formed on said radially projecting plate segment of said pouring spout, and said pouring spout is mounted fixed at the factory on said spout seating.

13. Plastic can according to claim 9, wherein said bearing eye has a materially integral web and said longitudinal groove is bounded axially at one end by said top wall and at the other end by said materially integral web.

14. Plastic can according to claim 1, wherein standing surfaces corresponding to said handles and said first plane surface of said screw cap are formed somewhat recessed in said bottom wall in such a way that, when identical plastic cans are stacked one upon another, said handles and said first plane surface are surrounded by regions of the bottom wall of the plastic can standing thereon, so that the upper can is secured against slipping laterally off of the lower can.

* * * * *